US005918307A

United States Patent [19]

Cipolla

[11] Patent Number: 5,918,307

[45] Date of Patent: Jun. 29, 1999

[54] UNDERWATER PROJECTILE LAUNCHER

[75] Inventor: Jeffrey L. Cipolla, Newport, R.I.

[73] Assignee: The United States of America as represented by the Secretary of the Navy, Washington, D.C.

[21] Appl. No.: 08/912,963

[22] Filed: Aug. 7, 1997

[51] Int. Cl.[6] ..... F41F 3/10

[52] U.S. Cl. ..... 89/1.81; 114/238; 89/5

[58] Field of Search ..... 89/1.809, 1.81, 89/5; 42/1.14; 114/238

[56] References Cited

U.S. PATENT DOCUMENTS

| | | | |
|---|---|---|---|
| 3,137,203 | 6/1964 | Brown | 89/1.81 |
| 3,279,319 | 10/1966 | Semonian et al. | 89/1.81 |
| 3,516,380 | 6/1970 | Johnston | 114/238 |

FOREIGN PATENT DOCUMENTS

| | | | |
|---|---|---|---|
| 3940583 | 6/1991 | Germany | 89/1.81 |

*Primary Examiner*—Charles T. Jordan
*Assistant Examiner*—Christopher K. Montgomery
*Attorney, Agent, or Firm*—Michael J. McGowan; Prithvi C. Lall; Michael F. Oglo

[57] ABSTRACT

Disclosed is an underwater gas generator projectile launcher which includes a tubular barrel having a forward muzzle end and an opposed rearward end. A projectile is positioned in this tubular barrel adjacent the forward end. An expellable closure for the forward muzzle end of the barrel means is provided. A projectile propelling piston assembly is positioned in the tubular barrel and includes a shell axially movable in the tubular barrel. This piston includes a shell having a front wall adjacent the projectile and an opposed rear wall which encloses the rearward end of the tubular barrel. This interior space is traversely segmented into a front chamber and a rear chamber by an interior plate, and this interior plate is positionable in a stationary position relative to said tubular barrel. A gas generator is positioned in the front chamber of the interior space. When the gas generator is activated, force is simultaneously applied to the front wall of the shell and the interior plate of the projectile propellant piston to move the shell of said piston in a forward direction to propel the projectile from said tubular barrel. External ocean pressure on the closure for the forward muzzle end of the tubular muzzle is equalized by force extracted in the opposite direction on the rear wall of the moveable shell by external ocean pressure.

20 Claims, 2 Drawing Sheets

UNDERWATER PROJECTILE LAUNCHER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to ordnance and more particularly to ordnance adapted for underwater use.

(2) Description of the Prior Art

The prior art discloses numerous uses of gas generator launchers for missiles, counter-measures and other devices launched from submarines. Such systems are advantageous, because of the low cost and high energy density of chemical propellant gas generators, but their use on submarines often requires significant overdesign in order to function properly at all operating depths.

Current gas generator launching systems are essentially gun-like, closed-breech sealed tubes with a gas generator propellant system behind the projectile. At firing, the gas generator's released energy must overcome not only the inertia of the projectile and loss forces, but also the static load of the exterior ocean pressure. Consequently, the gas generator system must be designed to function at some maximum depth; often, this requirement yields a design with much more energy than would be required to launch at shallow depths. In addition, the resulting launch system will have different launch ballistics at different depths.

A need, therefore, exists for an underwater gas generator projectile launch system which does not need to overcome the static load of exterior ocean pressure.

A need also exists for an underwater gas generator projectile launch system which has essentially constant launch ballistics regardless of launch depth.

A need also exists for an underwater gas generator projectile launch system which does not need to overcome exterior ocean pressure, has launch ballistics independent of depth and also captures generated gas so as to minimize signature.

SUMMARY OF THE INVENTION

Accordingly, an object of the present invention is to provide an efficient means of using gas generators in underwater launching systems.

Another object is to provide a launching system as aforesaid which balances external ocean pressure on both sides of a projectile, making the system depth independent.

A further object is to provide a launching system as aforesaid which captures generated gas, thus minimizing signature at launch.

A yet further object is to provide a launcher system as aforesaid which can be retrofitted to external tube-type launchers.

The apparatus of the present invention is an underwater gas generator projectile launcher which includes a tubular barrel means having a forward muzzle end and an opposed rearward end. A projectile is positioned in this tubular barrel means adjacent the forward end. An expendable means for closing the forward muzzle end of the barrel means is provided. A projectile propelling piston assembly is positioned in the tubular barrel. This piston assembly comprises a shell having an interior space, an interior plate in this interior space and an axial rail. The shell is mounted on the rail to be axially moveable in the tubular barrel. The shell has a front wall adjacent the projectile and an opposed rear wall which encloses the rearward end of the tubular barrel means. This interior space is traversely segmented into a front chamber and a rear chamber by the interior plate, and this interior plate is positionable to remain stationary relative to said tubular barrel means. A means for increasing gas pressure such as a gas generation means is positioned in the front chamber of the interior space. When the gas generation means is activated, force is simultaneously applied to the front wall of the shell and the interior plate of the projectile propellant piston to move the shell of said piston in a forward direction to propel the projectile from said tubular barrel means. Exterior ocean pressure on the removable means for closing the forward end of the tubular muzzle means is nearly equalized by force exerted in the opposite direction on the rear wall of the moveable shell by exterior ocean pressure; the only differential force being the pressure on the cross sectional area of the rail.

BRIEF DESCRIPTION OF THE DRAWINGS

Other objects, features and advantages of the present invention will become apparent upon reference to the following description of the preferred embodiments and to the drawings, wherein.

DETAILED DESCRIPTION OF THE PREFERRED EMBODIMENT

Figure 1:
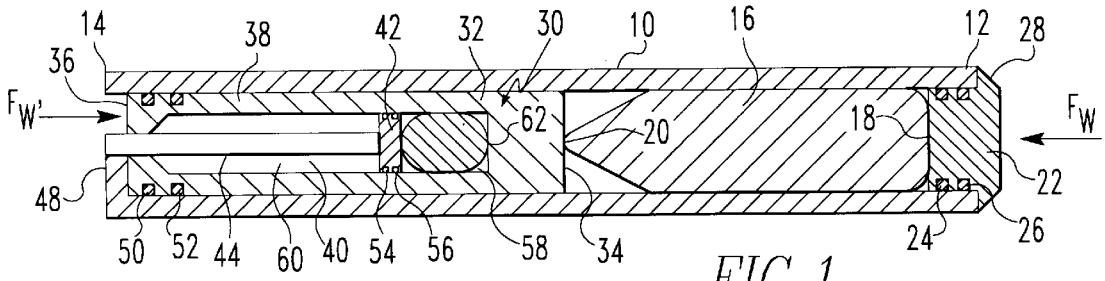
FIG. 1 is a vertical cross sectional schematic view of a preferred embodiment of the apparatus of the present invention in its prelaunch configuration.

Referring to FIG. 1, the apparatus of the present invention includes a tubular barrel 10 which has a forward muzzle end 12 and an opposed rearward end 14. Inside the tubular barrel 10, there is a projectile 16 which has a front face 18 and a base end 20. The front face 18 bears against an expellable muzzle cap 22 which closes the forward muzzle end 12 of the tubular barrel 10. Between the muzzle cap 22 and the tubular barrel 10, there are O-ring peripheral seals 24 and 26. The muzzle cap 22 also has a peripheral front flange 28 which overlaps the front edge of the tubular barrel 10. Mounted rearwardly from the projectile 16 there is a projectile propellant piston assembly 30 which serves to propel the projectile from the tubular barrel in a manner which will be described below. This piston assembly 30 includes a moveable shell 32 which has a front wall 34, a rear wall 36 and a connecting longitudinal tubular wall 38. These walls all enclose an interior space 40. The piston also includes an interior plate 42. Plate 42 is moveable in the interior space 40, but it is positionable against rail 44 inside the interior space 40 of the moveable shell 32. When the interior plate 42 is positioned to bear against the axial rail 44, it will, as is explained further below, move rearwardly relative to the moveable shell 32. The axial rail 44 passes through an axial bore 46 (FIG. 3) in the rear wall 36 of the moveable shell 32. Behind the rear wall 36 of the moveable shell 32 there is a transverse support 48 which extends radially inwardly from the tubular barrel 10 to support the axial rail 44. Between the rear wall 36 of the moveable shell 32 and the tubular barrel 10 there are peripheral O-ring seals 50 and 52. Between the interior plate 42 and the moveable shell 32 there are peripheral O-rings 54 and 56. The interior plate 42 divides the interior space 40 of the moveable shell 32 into a separate front chamber 58 and a rear chamber 60. Positioned in the front chamber 58 there is a gas generation means 62. The gas generation means may be one of any of the well known types of chemical energy storage solid, liquid or gaseous propellants. The energy of these propellants also may be boosted through the incorporation of an electrical energy system or stored mechanical energy, e.g. gas in a pressure vessel. The apparatus is submerged in water and exterior ocean pressure is exerted on the apparatus over its entire surface. Such water pressure is shown as $F_w$ on muzzle cap 22 and the essentially equal and oppositely directed $F_w'$ on rear wall 36 of moveable shell 32.

Figure 2:
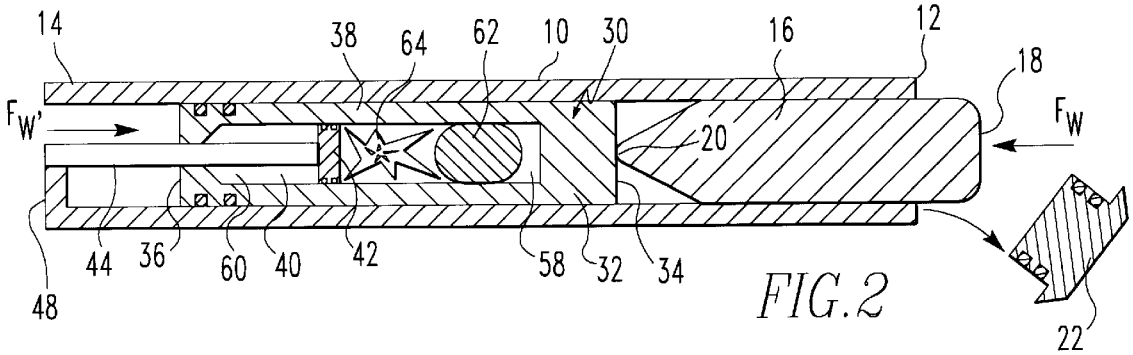
FIG. 2 is a vertical cross section schematic of the apparatus shown in FIG. 1 during launch.

The operation of the above described apparatus is described with reference to FIGS. 2 and 3. Referring particularly to FIG. 2, upon firing, the gas generator 62 is activated to create a pressurized gas mass 64 in the front chamber 58 which presses the interior plate 42 against the rail 44 and pushes the moveable shell 32 forward so that the front wall 34 pushes against the rearward end 20 of the projectile 16. The front face 18 of the projectile 16 therefore expels the muzzle cap 22 from the front end 12 of the tubular barrel 10 and the seals 24, 26, 50, 52, 54 and 56 are broken. After expulsion of the muzzle cap 22, water pressure as exterior ocean pressure $F_w$ is exerted on the forward end 18 of the projectile 16, but this force is generally equalized by oppositely directed force resulting from water pressure as external ocean pressure $F_w'$ on rear wall 36 of moveable shell 32. External ocean pressure is thus nearly equilibrated. The forces on the face 18 of the projectile 16 and the aft wall 36 of the moveable shell 32 differ only by the pressure on the cross sectional area of the rail 44. The gas generator 62 needs to supply energy to overcome the inertia of the moveable shell 32 and to seat interior plate 42, but not to overcome all of the external ocean pressure.

Figure 3:
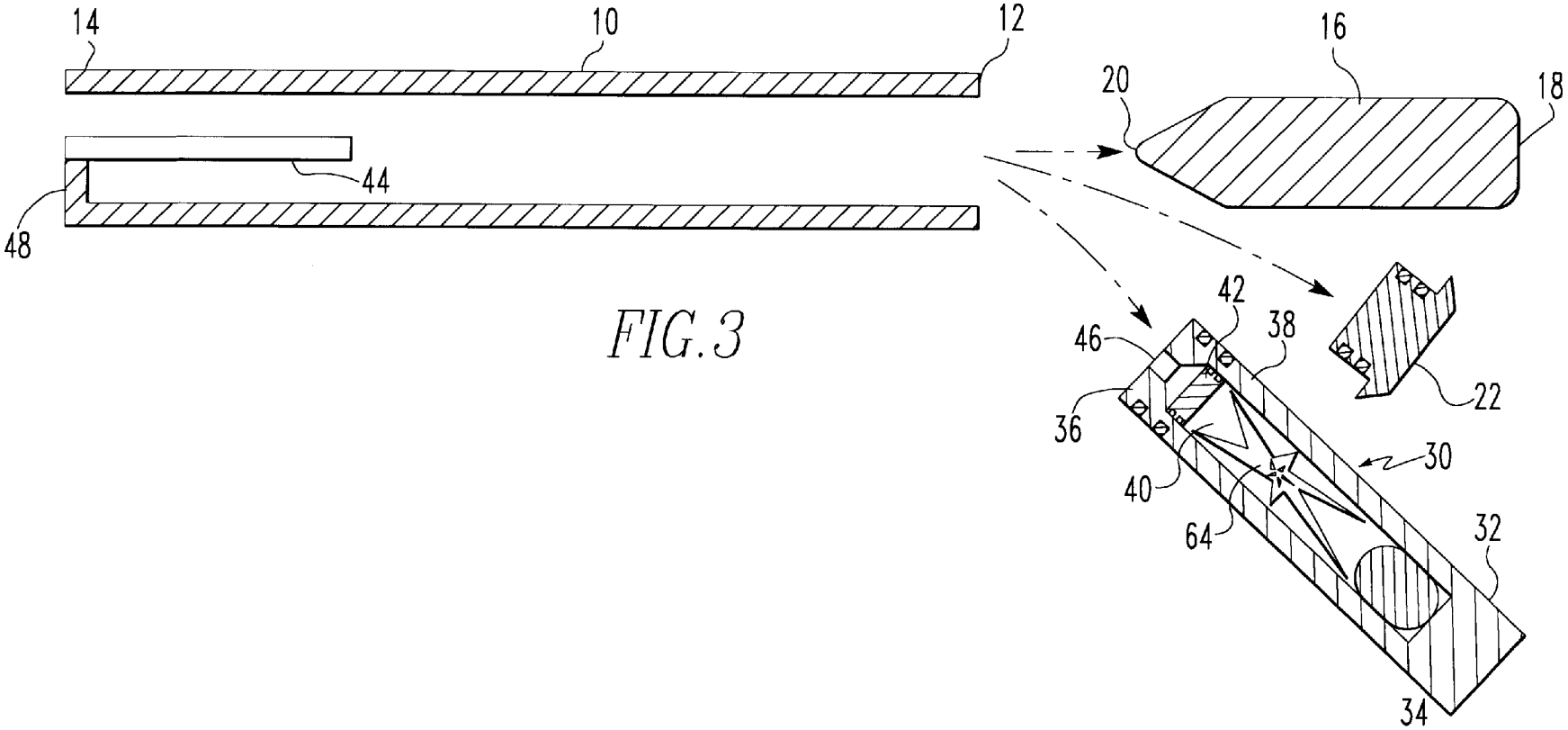
FIG. 3 is a vertical cross sectional schematic of the apparatus shown in FIG. 1 in its post launch configuration.

Referring particularly to FIG. 3, a post launch view is shown in which the projectile 16 is outside the muzzle end 12 of the tubular barrel 10. The projective propellant piston assembly 30 including the shell 32 and the interior plate 42, and the muzzle cap 22 are expended. A launch signature is minimized since much of the gas mass 64 will, at least for a time, be retained in the interior space. The tubular barrel 10 and the rail 44 will be reusable.

By means of the apparatus of the present invention the variability in ballistic performance with depth of gas generator launch systems by equilibrating the pressure fore and aft is essentially eliminated. Also, overall system energy is significantly reduced over that of a non-equilibrated system, with favorable cost and acoustic implications. The non-consumable items, the tubular barrel 10 and the rail 44 contain no combustion products and are reusable. Because most combustion products are contained in the expended shell 32, a launch signature is largely eliminated. It will also be appreciated that an existing external launcher may be retrofitted by means of the present invention. For example, the MK 71 external launcher used by the United States Navy includes a steel barrel having two open ends with a gas generator in the breech. Such a device may be retrofitted by removing the gas generator assembly and replacing it with a piston assembly as is described above.

While the present invention has been described in connection with the preferred embodiments of the various elements, it is to be understood that other similar embodiments may be used or modifications and additions may be made to the present described embodiment for performing the same function of the present invention without deviating therefrom. Therefore, the present invention should not be limited to any single embodiment, but rather construed in breadth and scope in accordance with the recitation of the appended claims.

What is claimed is:

1. An apparatus for launching a projectile when submerged in external water comprising:

a tubular barrel means having a forward muzzle end and an opposed rearward end;

a projectile positioned in said tubular barrel means adjacent said forward end;

expellable means for closing the forward muzzle end of the barrel means which means for closing the forward muzzle end of the barrel means is interposed between the external water and the projectile;

means for propelling the projectile interposed between the projectile and the rearward end of the tubular barrel means and being axially moveable in the tubular barrel means to move the projectile toward the forward end of the tubular barrel means;

means for nearly equalizing the force exerted by the external water on the means for closing the muzzle by force exerted on the means for propelling the projectile, said means for nearly equalizing the force comprising the means for propelling the projectile being exposed to the external water when said means for propelling the projectile is activated;

said means for propelling the projectile further comprising a shell axially movable in the tubular barrel means and having a front wall adjacent the projectile and an opposed rear wall enclosing an interior space wherein said interior space is traversely segmented into a front chamber and a rear chamber;

said means for propelling the projectile still further comprising an interior plate wherein said interior plate is positionable in a stationary position relative to said tubular barrel means and said rear wall of said shell closes said rearward end of the tubular barrel means; and said means for propelling the projectile yet further comprising means for increasing gas pressure in said front chamber of the interior space, whereby when said means for increasing gas pressure is activated, force is simultaneously applied to the front wall of the shell and the interior plate of the means for propelling the projectile to move the shell of said means for propelling the projectile in a forward direction to propel the projectile from said tubular barrel means.

2. The apparatus of claim 1 wherein the means for increasing gas pressure is a gas generation means disposed in said front chamber.

3. The apparatus of claim 2 wherein when the shell moves forward the means for closing the forward muzzle end of the tubular barrel is removed.

4. The apparatus of claim 2 wherein, prior to activation of the gas generation means, the force exerted by the exterior water on the expellable means for closing the forward muzzle end acts on said means for propelling the projectile in a rearward direction, and said external water to which said means for propelling the projectile is exposed provides said nearly equalizing force by acting on the means for propelling the projectile in a forward direction.

5. The apparatus of claim 4 wherein force is exerted on the rear wall of the movable shell in a forward direction by the exterior water.

6. The apparatus of claim 5 wherein the rearward force exerted by the exterior water on the means for closing the forward muzzle end is about equal to the forward force exerted by the ambient water on the rear wall of the shell.

7. The apparatus of claim 6 wherein after activation of the means for increasing gas pressure in the forward chamber of the movable shell force continues to be exerted by the exterior water on the rear wall of said shell as said shell moves forward.

8. The apparatus of claim 7 wherein after removal of the means for closing the forward muzzle end of the tubular barrel means, force is exerted by the exterior water on the projectile in a rearward direction.

9. The apparatus of claim 8 wherein the force exerted by the exterior water on the projectile in a rearward direction is approximately equal to the continuing force exerted by the exterior water on the rear wall of the shell in a forward direction.

10. The apparatus of claim 2 wherein there is a peripheral seal between the means for closing the forward muzzle end of the tubular barrel means and said tubular barrel means.

11. The apparatus of claim 10 wherein there is a peripheral seal between the shell and the tubular barrel means.

12. The apparatus of claim 11 wherein the seal between the shell and the tubular barrel means is adjacent the rear wall of the shell.

13. The apparatus of claim 2 wherein the interior wall of the piston is fixed to an axial rail and there is an axial bore in the rear wall of the shell and said axial rail passes through said axial bore.

14. The apparatus of claim 13 wherein the axial rail is mounted in stationary relation to the tubular barrel means.

15. The apparatus of claim 14 wherein the shell is movable on the axial rail.

16. The apparatus of claim 14 wherein the axial rail is mounted on a transverse support extending inwardly from the tubular barrel means and disposed rearwardly of the rear wall of the shell.

17. The apparatus of claim 16 wherein there is a peripheral seal between the interior wall and the shell.

18. An apparatus for launching of a projectile submerged in external water comprising:

a tubular barrel means having a forward muzzle end and an opposed rearward end and having a rail means extending axially therein from said rearward end;

a projectile positioned in said tubular barrel means adjacent said forward muzzle end;

an expellable removable means for closing the forward muzzle end of the barrel means and being interposed between external water and the projectile;

a projectile propellant piston positioned in the tubular barrel and having a shell axially movable in the tubular barrel means and having a front wall adjacent the projectile and an opposed rear wall having an axial bore and said front and rear walls enclosing an interior space wherein said interior space is traversely segmented into a front chamber and a rear chamber by an interior plate which bears against the axial rail wherein the rear wall of said shell closes said rearward end of the tubular barrel means from the external water; and a gas generation means positioned in said front chamber of the interior space whereby when said gas generation means is activated force is simultaneously applied to the front wall of the shell and the interior plate of the projectile propellant piston to move the interior plate against the rail and move the shell of said piston on the rail in a forward direction to propel the projectile from said tubular barrel means.

19. In an apparatus for launching a projectile submerged in external water the combination comprising:

a tubular barrel means having a forward muzzle end and an opposed rearward end;

a projectile positioned in said tubular barrel means adjacent said forward muzzle end;

means for propelling said projectile from said forward muzzle end of the tubular barrel means;

means for nearly equalizing force exerted on the projectile by external water from the forward muzzle end of the tubular barrel means with force exerted by external water from the opposed rearward end;

said means for propelling the projectile being interposed between the projectile and the rearward end of the tubular barrel, and further being axially moveable in the tubular barrel means to move the projectile toward the forward end of the tubular barrel means;

said means for nearly equalizing the force on the projectile comprising the means for propelling the projectile being reawardly exposed to the external water when said means for propelling the projectile is activated;

said means for propelling the projectile further comprising a shell axially movable in the tubular barrel means and having a front wall adjacent the projectile and an opposed rear wall enclosing an interior space wherein said interior space is traversely segmented by into a front chamber and a rear chamber;

said means for propelling the projectile still further comprising an interior plate wherein said interior plate is positionable in a stationary position relative to said tubular barrel means and said rear wall of said shell closes said rearward end of the tubular barrel means; and said means for propelling the projectile yet further comprising means for increasing gas pressure in said front chamber of the interior space, whereby when said means for increasing gas pressure is activated, force is simultaneously applied to the front wall of the shell and the interior plate of the means for propelling the projectile to move the shell of said means for propelling the projectile in a forward direction to propel the projectile from said tubular barrel means.

20. The apparatus of claim 19 wherein the means for increasing gas pressure is a gas generation means disposed in said front chamber.

* * * * *